United States Patent [19]

Cornelia

[11] Patent Number: 4,923,752

[45] Date of Patent: May 8, 1990

[54] SIZING FOR CARBON FIBER

[75] Inventor: Richard H. Cornelia, Hockessin, Del.

[73] Assignee: E. I. Du Pont de Nemours & Co., Wilmington, Del.

[21] Appl. No.: 145,111

[22] Filed: Jan. 19, 1988

[51] Int. Cl.[5] ..... C08K 5/20; C08K 5/36; C08K 5/34; C08L 77/10

[52] U.S. Cl. ..... 428/367; 428/224; 428/378; 428/408; 524/104; 524/173; 524/234; 524/378

[58] Field of Search ..... 524/600, 104, 173, 234, 524/378; 528/393; 428/367, 408

[56] References Cited

U.S. PATENT DOCUMENTS 4,631,335 12/1986 Scola ..... 524/600

*Primary Examiner*—C. Warren Ivy

[57] ABSTRACT

An improved carbon fiber size of fluorinated poly(amide-acid).

4 Claims, No Drawings

SIZING FOR CARBON FIBER

BACKGROUND OF THE INVENTION

The use of carbon fiber for high temperature composite applications is of growing interest. Greater adaptability, however, is dependent at least in part to achieving improvements in handleability of the carbon fiber yarn in processing and in the production of composites with good resin dominated mechanical properties, such as compressional properties and interlaminar shear strength. The use of agents which might permit attainment of these objectives is limited to those which can withstand high temperatures encountered in production and use of parts from the composites. Thus, standard epoxy sizes are unacceptable since they are unstable at the temperatures required in the cure cycles. Attempts to use these sizes would lead to degradation at the interface between the fiber and resin matrix where good adhesion is vital to obtaining the desired mechanical properties. Unsized carbon fiber has poor handling characteristics leading to severely reduced yields and poor quality when the fiber is woven.

SUMMARY OF THE INVENTION

This invention provides a novel sizing composition comprising from 0.5–10% of a fluorinated poly(amide-acid) in a mixture of an aprotic solvent of the group dimethyl sulfoxide, dimethyl formamide, diglyme and N-methylpyrrolidone and an alcohol of the group consisting of methanol, isopropanol and ethanol, the mixed solvent having a ratio of aprotic solvent to alcohol of 1:4 to 1:20 on a weight basis. Carbon fiber having a uniform continuous coating of the poly(amideacid) and composites comprising a polyimide matrix reinforced with from 50 to 70 volume % of such coated carbon fiber are also encompassed by the present invention.

DETAILED DESCRIPTION OF THE INVENTION

The carbon fiber substrate employed in the present invention may be of either the PAN-based or pitch-based variety and may be in the form of yarn or fabric of the yarn. Such materials are commercially available. Preparation of the size usually involves synthesis of the fluorinated poly(amide-acid) in a suitable anhydrous aprotic solvent, conveniently dimethylsulfoxide, dimethylformamide (DMF) diglyme or N-methyl-pyrrolidone (NMP). Fluorinated poly(amideacid) is selected because of the high $T_g$ needed for high temperature use. The poly(amide-acid) prepared by a substantially stoichiometric reaction between 2,2-bis(3',4'-dicarboxyphenyl)hexafluoropropane dianhydride and a 95:5 mixture of para- and meta-phenylene diamine in a suitable solvent is preferred. Perfluorinated poly(amide-acids) such as are disclosed in U.S. Pat. Nos. 3,959,350, 4,336,175, 4,111,906 and may be used for this application.

It is generally not desirable to use the poly(amide-acid) in an aprotic solvent, such as NMP, directly as a size for several reasons. For one thing, it would not yield the desired thin, continuous uniform coating desired on the carbon fiber. Another factor is the problem involved in removing substantial quantities of NMP when the polymer is cured. For these reasons, the NMP-polymer solution is diluted with a low molecular weight alcohol, such as methanol, isopropanol or preferably ethanol. The alcohol is added to the mixture of poly(amide-acid) and aprotic solvent prior to application to the fiber. The alcohol lowers the surface tension of the solution, causes no precipitation of the polymer and offers a high vapor pressure for ease of removal during curing of the thread line. These features are believed to promote formation of a thin uniform continuous coating on the fiber and improved matrix dominated properties in the composite.

In accordance with the present invention, the size is applied to the yarn by conventional means such as dipping or spraying and is cured as by passing through a heated oven to remove residual solvent. The latter should be reduced to less than 1% to prevent binding of adjacent yarn ends which would interfere with yarn delivery during take-off from the package. It is then wound on a package for later handling, e.g., weaving into fabric. If desired, the fabric may be woven prior to application of the size, but this of course will forego the advantage of improved handling. In either case, an amount of size solution is applied which will leave an add-on of up to about 3% and preferably less than about 1% by weight. Excessive size levels result in a stiffened yarn bundle which may inhibit impregnation of the yarn bundle during prepregging. As is well known in the art, it is important that the matrix polymer get within the bundle and surround each filament in the bundle.

The size composition of this invention is particularly effective in wetting the carbon fiber and producing a thin, exceptionally uniform film over the surface of the fiber. It is believed that this film is responsible for the improved resin dominated properties of polyimide composites reinforced with such sized fiber. High temperature polyimides would normally be employed as matrix material to be reinforced with the coated carbon fiber. Preferred polyimides for the matrix of composites in accordance with the present invention are those described in U.S. Pat. No. 4,576,857. These are formed from pyromellitic dianhydride and an aromatic diamine and contain up to about 10% of end-capped amino or anhydride groups. From about 50 to 70 volume % of fiber is often used in advanced composites.

Following accepted procedures laminates containing about 57% fiber on a volume basis were formed from plain weave fabrics of carbon fiber sized with the size of the invention and then impregnated with a polyimide ("Avimid"/K-III from E. I. du Pont de Nemours and Company) and finally processed in an autoclave. Tests showed that laminates constructed from sized fiber had improved compression properties compared to unsized control laminates.

The foregoing advantages could permit the design of lighter weight composite structures with equal or improved levels of performance.

EXAMPLE

To a 5-liter vessel was added 2,007 ml. of dry N-methylpyrrolidone (NMP) and the solvent was blanketed with nitrogen. To this was added 266.6 grams (0.6 mole) of 2,2-bis(3',4,-dicarboxyphenyl) hexafluoropropane dianhydride with the residual solids in the funnel washed in with an additional 400 ml. of NMP. This mixture was stirred to achieve a clear solution (ca. one hour) and then there was added a mixture of 61.6 g. of para-phenylenediamine and 3.2 g. of metaphenylenediamine (total diamine 0.6 mole) with the residual solids washed in with a final 500 ml. of NMP. The reaction was stirred well under a blanket of dry nitrogen for 60 minutes and then filtered to remove trace amounts of undissolved solids.

This master sizing solution at 10% solids in NMP was then diluted while stirring with ethanol to yield a 9:1 ethanol:NMP solvent ratio now containing 1.0% solids. Thus, to every 100 g. of master sizing solution there was added 900 g. of ethanol to yield the final 1.0% sizing bath.

Unsized carbon fiber yarn (Hercules 3K AS-4) was passed at ca. 100 ft/minute over two consecutive kiss rolls rotating in the 1.0% sizing solution yielding ca. 100% wet pick-up (1.0 g. sizing solution applied per 1.0 g. of yarn). This wetted yarn was continually passed through an oven heated to 160°-180° C. to dry and cure the sizing on the yarn yielding a final 1.0±0.25% size add-on based on weight. The sized yarn was wound on cylindrical tubes and delivered to the weaver.

For comparison, both sized and unsized plain weave fabrics were separately woven at 12.5 ends/inch using 12.5 picks/inch. These two fabrics were consecutively impregnated with a polyimide solution using standard industry practices to yield Avimid/K-III woven prepreg. Quasi-isotropic 20-ply laminates of the sized and unsized AvimidK-III (~57 vol. % fiber) were prepared via autoclave curing (vacuum bagging) using a lay-up of −45, 0, +45, 90, five times with reversal of direction after 2.5 times.

The cure cycle used was:

| Cure Cycle |
|---|
| 1. Apply 5 inches Hg vacuum. |
| 2. Heat to 350° F. at 1° F./minute. |
| 3. Apply 28 inches Hg vacuum at 350° F. |
| 4. Heat to 650° F. at 1° F./minute. |
| 5. Apply 185 psi pressure at 10 psi/minute. |
| 6. Hold at 650° F. for 60 minutes. |

-continued

| Cure Cycle |
|---|
| 7. Cool to 480° F. at 1° F./minute. |
| 8. Cool to 120° F. at 5° F./minute. |
| 9. At 120° F., release pressure first - then release vacuum. |

Mechanical properties, and specifically open hole compression, were measured according to procedures outlined in Boeing document BSS 7260. Evaluated both at room temperature and at 350° F., the sized laminate yielded open hole compression strengths of 40.5 and 29.2 ksi, respectively. The unsized laminate yielded values at the same temperatures (RT and 350° F.) of 35.6 and 23.4 ksi, respectively, clearly showing an advantage for the sized laminates of 14 and 25%.

I claim:

1. A size composition comprising from 0.5 to 10% by weight of a fluorinated poly(amide-acid) in a mixture of an aprotic solvent of the group comprising dimethyl sulfoxide, dimethylformamide, diglyme and N-methylpyrrolidone and an alcohol of the group consisting of methanol, isopropanol and ethanol, the mixed solvent having a ratio of aprotic solvent to alcohol of from 1:4 to 1:20 on a weight basis.

2. A size composition according to claim 1 wherein the polymer is formed by a substantially stoichiometric reaction between 2,2-bis(3′,4′-dicarboxyphenyl) hexafluoropropane dianhydride and a mixture of para- and meta-phenylene diamine in about a 95:5 ratio in anhydrous N-methylpyrrolidone.

3. A size composition according to claims 1 or 2 wherein the solvent mixture is N-methylpyrrolidone and ethanol.

4. Carbon fiber having a uniform continuous coating of up to about 3% by weight of a fluorinated poly(amide-acid) formed by application to the carbon fiber of the size composition of claims 2 or 3.

* * * * *